US012377335B2

(12) United States Patent
McCarter

(10) Patent No.: US 12,377,335 B2
(45) Date of Patent: Aug. 5, 2025

(54) PRACTICE AID SYSTEM

(71) Applicant: Zevon McCarter, Temple Terrace, FL (US)

(72) Inventor: Zevon McCarter, Temple Terrace, FL (US)

( * ) Notice: Subject to any disclaimer, the term of this patent is extended or adjusted under 35 U.S.C. 154(b) by 914 days.

(21) Appl. No.: 17/194,248

(22) Filed: Mar. 6, 2021

(65) Prior Publication Data

US 2021/0187377 A1 Jun. 24, 2021

Related U.S. Application Data

(63) Continuation-in-part of application No. PCT/US2020/040434, filed on Jul. 1, 2020, which is a continuation-in-part of application No. 16/460,698, filed on Jul. 2, 2019, now abandoned.

(51) Int. Cl.

| | |
|---|---|
| ***A63B 69/00*** | (2006.01) |
| ***A43B 3/34*** | (2022.01) |
| ***A63B 43/06*** | (2006.01) |
| ***A63B 71/06*** | (2006.01) |

(52) U.S. Cl.

CPC ..... *A63B 69/0071* (2013.01); *A43B 3/34* (2022.01); *A63B 43/06* (2013.01); *A63B 71/0605* (2013.01); *A63B 71/0622* (2013.01); *A63B 71/0686* (2013.01); *A63B 2071/0655* (2013.01); *A63B 2071/0663* (2013.01); *A63B 2220/803* (2013.01); *A63B 2220/805* (2013.01); *A63B 2220/833* (2013.01); *A63B 2220/836* (2013.01); *A63B 2225/02* (2013.01); *A63B 2225/50* (2013.01); *A63B 2225/74* (2020.08)

(58) Field of Classification Search

CPC ..... A63B 69/0071; A63B 2220/803; A63B 2220/833; A63B 2220/805; A63B 2220/836; A63B 71/0605; A63B 71/0622; A63B 2071/0655; A63B 2071/0663; A63B 2225/74

USPC ..... 473/447

See application file for complete search history.

(56) References Cited

U.S. PATENT DOCUMENTS

| | | | | |
|---|---|---|---|---|
| 4,858,920 | A * | 8/1989 | Best | A63B 24/0021 473/480 |
| 8,845,461 | B2 * | 9/2014 | Duke | A63B 71/0669 473/480 |
| 8,968,100 | B2 * | 3/2015 | Hohteri | A63B 69/0071 342/42 |
| 9,186,568 | B2 * | 11/2015 | Ianni | H04M 1/72412 |
| 9,776,041 | B1 * | 10/2017 | Lachwani | A43B 3/34 |
| 2007/0135243 | A1 * | 6/2007 | LaRue | H04Q 9/00 473/467 |

* cited by examiner

*Primary Examiner* — Mitra Aryanpour

(74) *Attorney, Agent, or Firm* — Olav M. Underdal; IDP Patent Services

(57) ABSTRACT

A practice aid system includes: a practice aid device; a hoop sensor system, including first and second pairs of an optical transmitter and receiver, which are mountable on a rim of a basketball hoop; an intelligent ball, including an inflatable ball body, a ball control unit, a ball light source, and a ball motion and location sensor; an intelligent shoe, including a shoe body, a shoe control unit, a shoe motion and location sensor, a vibrator, and a shoe light source.

17 Claims, 8 Drawing Sheets

Practice Aid System

Practice Aid System

Practice Aid Server

PRACTICE AID SYSTEM

CROSS-REFERENCE TO RELATED APPLICATIONS

This U.S. Non-Provisional Application is a Continuation-In-Part of International Application No. PCT/US2020/40434, filed Jul. 1, 2020; which claims the benefit of U.S. Non-Provisional application Ser. No. 16/460,698, filed Jul. 2, 2019; both of which are hereby incorporated herein by reference in their entirety.

FIELD OF THE INVENTION

The present invention relates generally to the field of systems and methods for sports practice, and more particularly to methods and systems for providing corrective feedback and information about scores and gameplay.

BACKGROUND OF THE INVENTION

In practice of game play of sports requiring handling of a ball, trainers, referees, and players may frequently wish to register, transmit or receive game information and corrective feedback, for example relating to registering scores and communicating penalties or timeout.

However, conventional methods of communication, such as oral communication or hand signals, may be disruptive to game play.

As such, considering the foregoing, it may be appreciated that there continues to be a need for novel and improved devices and methods for providing corrective feedback and information about scores and gameplay.

SUMMARY OF THE INVENTION

The foregoing needs are met, to a great extent, by the present invention, wherein aspects of this invention, enhancements are provided to the existing model for providing information about scores and gameplay.

In an aspect, a practice aid system can include:

a) a practice aid device, which can be mounted on a forearm of a user;

b) a hoop sensor system, which can include:

i. a first sensor pair which can include:

a first optical transmitter, which is mountable on a first side of a basketball hoop rim; and a first optical receiver, which is mountable on a second side of the hoop rim, such that the first optical transmitter and receiver are opposedly mounted relative to the hoop rim; and ii. a second sensor pair, which can include:

a second optical transmitter, which is mountable on a third side of the hoop rim; and a second optical receiver, which is mountable on a fourth side of the hoop rim, such that the second optical transmitter and receiver are opposedly mounted relative to the hoop rim; and wherein the second sensor pair is configured to be perpendicularly mounted on the hoop rim relative to the first sensor pair;

wherein the practice aid device can be configured to register a score when the first sensor pair and the second sensor pair detect simultaneous first and second blockages;

c) an intelligent ball, which can include:

i. an inflatable ball body;

ii. a ball control unit;

iii. a ball light source, such that the ball light source is mounted to the inflatable ball body;

wherein the ball control unit is connected to the ball light source, such that the ball control unit is configured to control switching on and switching off the ball light source, in communication with the practice aid device;

d) an intelligent shoe, including:

i. a shoe body;

ii. a shoe control unit, which is mounted to the shoe body;

iii. a shoe motion and location sensor, which is mounted to the shoe body;

iv. a vibrator, which is mounted to the shoe body;

v. a shoe light source, which is mounted to the shoe body;

wherein the shoe control unit is connected to the shoe motion and location sensor, such that the shoe control unit receives motion information from the shoe motion and location sensor, in communication via the practice aid device;

wherein the shoe control unit is connected to the vibrator, such that the shoe control unit control switching on and switching off the vibrator, in communication via the practice aid device;

wherein the shoe control unit is connected to the shoe light source, such that the shoe control unit controls switching on and switching off the shoe light source, in communication via the practice aid device.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1A:
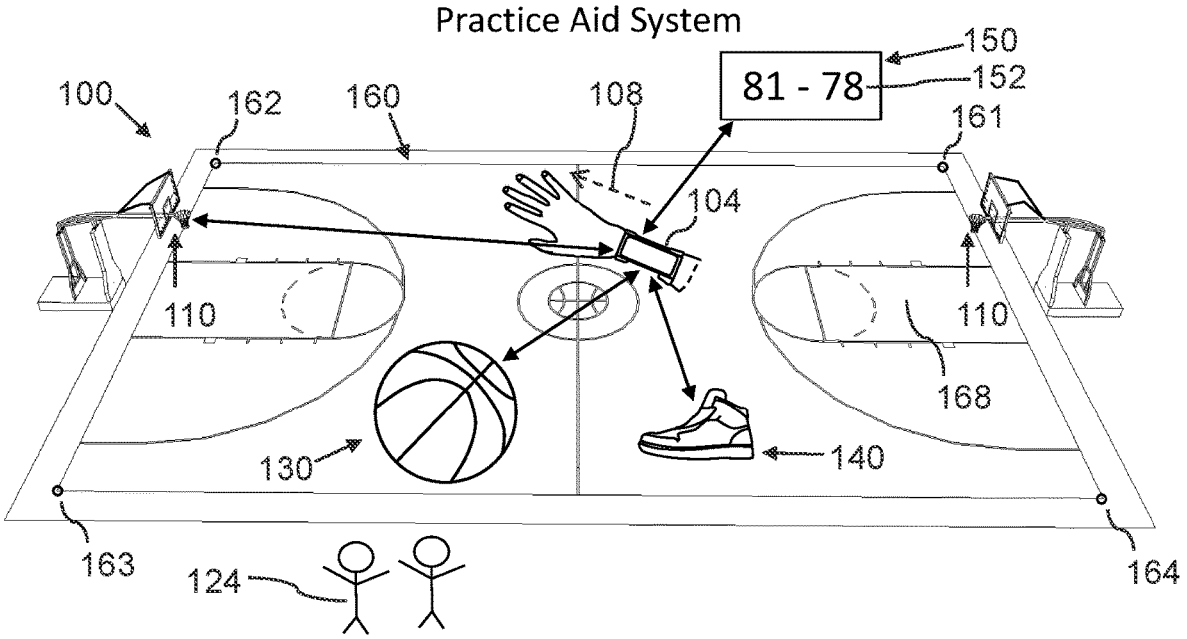
FIG. 1A is a schematic diagram illustrating a practice aid system, according to an embodiment of the invention.
Figure 1B:
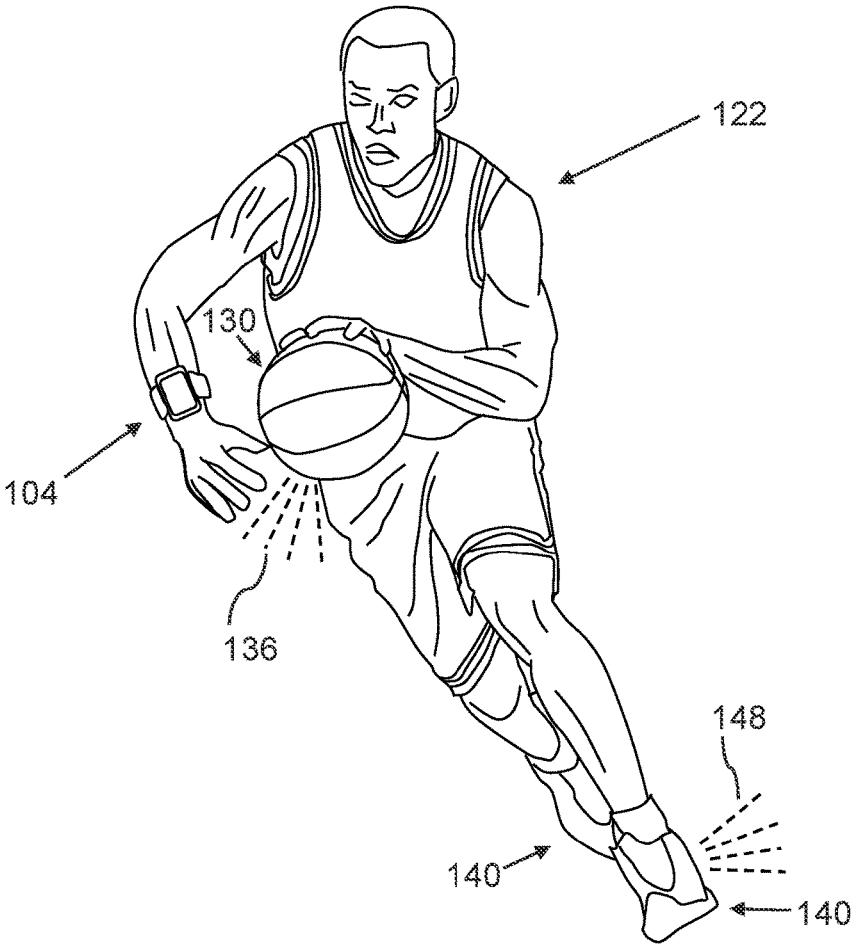
FIG. 1B is a schematic diagram illustrating a practice aid system, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a system for practice aid system 100 with reference to FIG. 1A, in such manner that like reference numerals refer to like components throughout; a convention that we shall employ for the remainder of this specification.

Figure 3A:
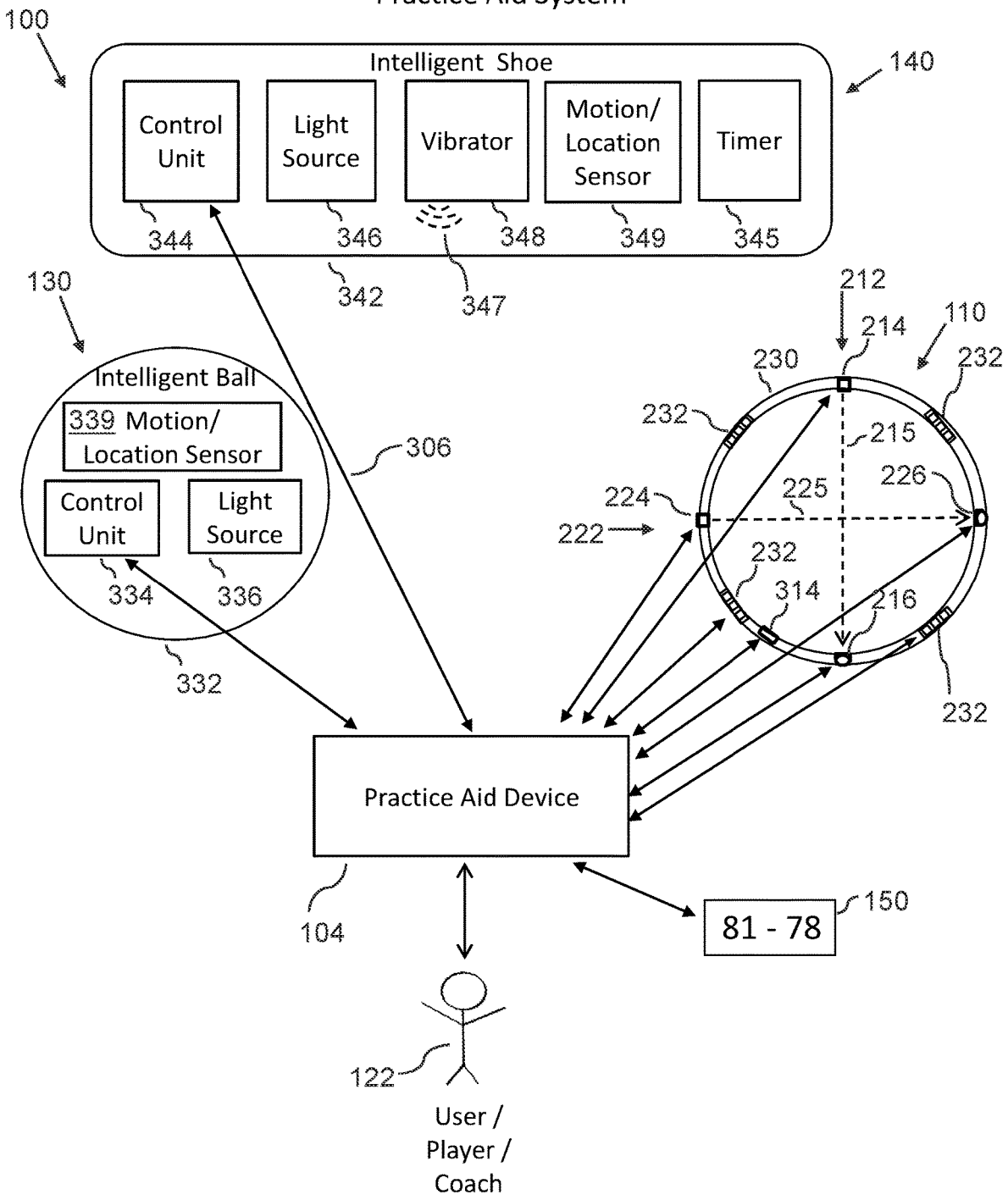
FIG. 3A is a schematic diagram illustrating a practice aid system, according to an embodiment of the invention.
Figure 3B:
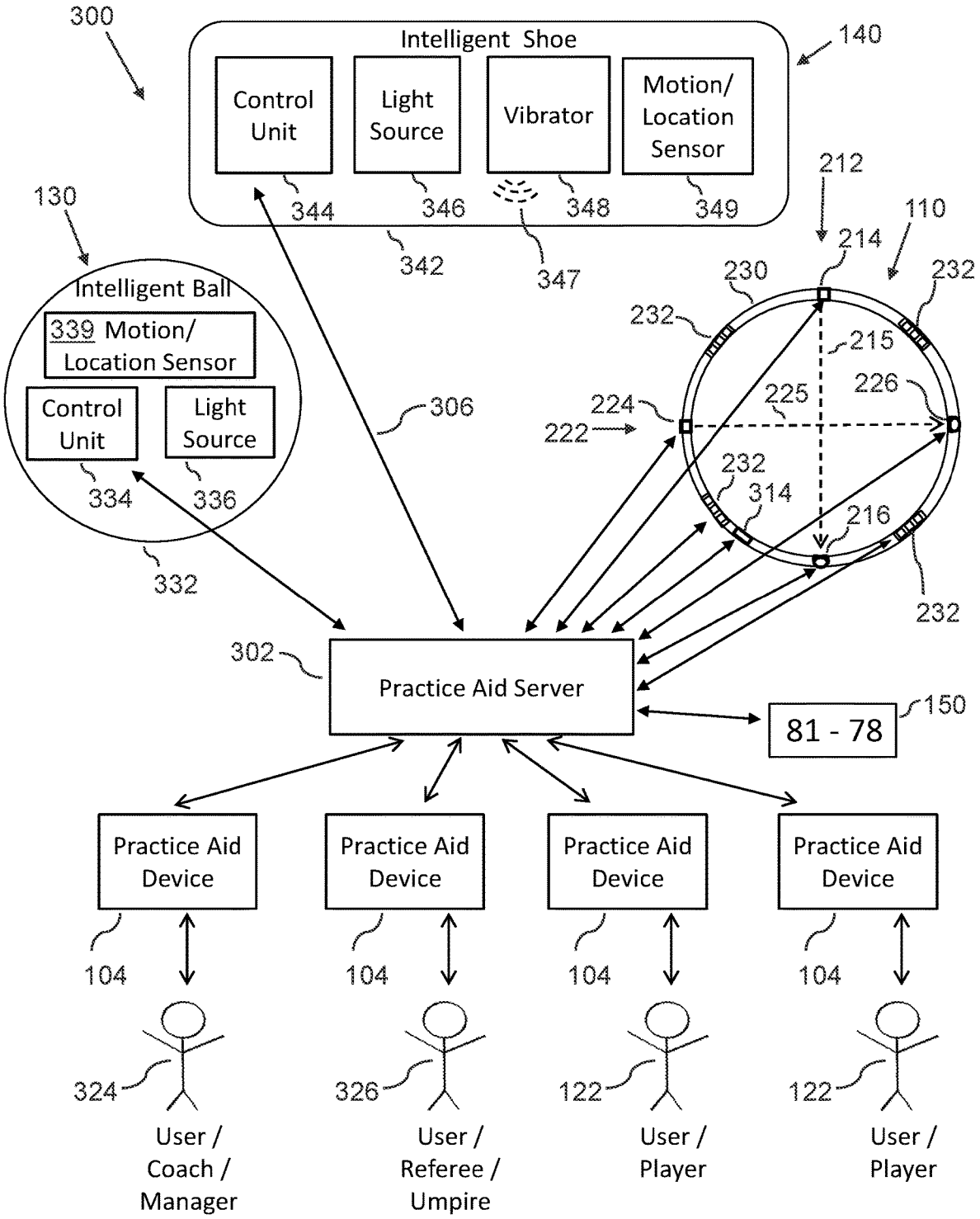
FIG. 3B is a schematic diagram illustrating a practice aid system, according to an embodiment of the invention.

In an embodiment, as shown in FIGS. 1A, 1B, 2A, 2B, 3A and 3B a practice aid system 100 can include:

a) a practice aid device 104, which can be configured to be mounted on a forearm of a user/player 122;

b) a hoop sensor system 110, as shown in FIGS. 2A-2B and 3A-3B, including:

i. a first sensor pair 212, including:

a first optical transmitter 214, which is configured to be mounted on a first side of a hoop rim 260 of a basketball hoop; and a first optical receiver 216, which is configured to be mounted on a second side of the hoop rim 260, such that the first and second sides are opposing sides of the hoop rim 260, such that the first optical receiver 216 receives a first optical emission 215 from the first optical transmitter 214 when there is no blockage of a first opening between the first optical transmitter 214 and the first optical receiver 216, and such that the first optical receiver 216 detects a first blockage of the first opening when the first optical emission is not received; and ii. a second sensor pair 222, including:

a second optical transmitter 224, which is configured to be mounted on a third side of the hoop rim 260; and a second optical receiver 226, which is configured to be mounted on a fourth side of the hoop rim 260, such that the third and fourth sides are opposing sides of the hoop rim 260, such that the second optical receiver 226 receives a second optical emission 225 from the second optical transmitter 224 when there is no blockage of a second opening between the second optical transmitter 224 and the second optical receiver 226, and such that the second optical receiver 226 detects a second blockage of the second opening when the second optical emission is not received; and wherein the second sensor pair 222 is configured to be perpendicularly mounted on the hoop rim 260 relative to the first sensor pair 212;

wherein the practice aid device 104 can be configured to register a score when the first sensor pair 212 and the second sensor pair 222 detect simultaneous first and second blockages of respectively the first and second openings;

c) an intelligent ball 130, as shown in FIGS. 3A and 3B, including:

i. an inflatable ball body 332;

ii. a ball control unit 334;

iii. a ball light source 336, which for example can be a light emitting diode assembly, such that the ball light source 336 is mounted to the inflatable ball body 332, for example inside the inflatable ball body 332, in a shell of the inflatable ball body 332 or on a surface of the inflatable ball body 332; and iv. a ball motion and location sensor 339, which is mounted to, including on a surface of or inside, the inflatable ball body 332, wherein the ball motion and location sensor 339 is configured to determine ball motion information of the intelligent ball 130 wherein the ball motion information can include a location/position and a velocity of the intelligent ball 130;

wherein the ball control unit 334 is connected to the ball light source 336, such that the ball control unit 334 is configured to control switching on and switching off of the ball light source 336, in communication with the practice aid device 104, such that the ball light source 336 can be configured to emit a game information ball light signal 136, which provides game information to players 122 and spectators 124, wherein the game information ball light signal 136 can be configured in various forms, such as with varying colors, varying rate of on/off pulsation, and/or varying intensity, in order to communication varying forms of game information, such as related to scores, game strategy, game statistics, etc.;

wherein the ball control unit 334 is connected to the ball motion and location sensor 339, such that the ball control unit 334 is configured to receive the ball motion information, such that the ball control unit 334 can communicate the ball motion information to the practice aid device 104 and/or the practice aid server 302;

d) an intelligent shoe 140, as shown in FIGS. 3A and 3B, including:

i. a shoe body 342;

ii. a shoe control unit 344, which is mounted to, including on a surface of or inside, the shoe body 342;

iii. a shoe motion and location sensor 349, which is mounted to, including on a surface of or inside, the shoe body 342, wherein the shoe motion and location sensor 349 is configured to determine shoe motion information of the intelligent shoe 140, wherein the shoe motion information can include a location/position and a velocity of the intelligent shoe 140;

iv. a vibrator 348, which is mounted to, including on a surface of or inside, the shoe body 342;

v. a shoe light source 346, which for example can be a light emitting diode assembly, such that the shoe light source 346 is mounted to the shoe body 342, for example inside the shoe body 342 or on a surface of the shoe body 342;

wherein the shoe control unit 344 is connected to the shoe motion and location sensor 349, such that the shoe control unit 344 can be configured to receive shoe motion and location information from the shoe motion and location sensor 349, in communication with the practice aid device 104, wherein the motion information can include a location/position and a velocity of the intelligent shoe 140;

wherein the shoe control unit 344 is connected to the vibrator 348 such that the shoe control unit 344 can be configured to control switching on and switching off of the vibrator 348, in communication with the practice aid device 104, such that the vibrator 348 is configured to emit a game information vibration signal 347, which is received by the player 122 who is wearing the intelligent shoe 140, wherein the game information vibration signal 347 provides game information to the player 122;

wherein the shoe control unit 344 is configured to start a timer 345 when the shoe motion and location sensor 349 indicates the player 122 has entered a defensive key zone 168 (of the basketball court 160), such that the timer 345 stops when the player 122 has left the defensive key zone 168, such that the vibrator 348 is configured to emit a game information vibration signal 347, which is a warning vibration signal, when the timer 345 reaches two seconds, to warn the player 122 of a potential three second key zone violation, which can be used for training or during gameplay. The warning vibration signal can for example be a continuous relatively strong and fast vibration, which stops when the player leaves the defensive key zone 168; and wherein the shoe control unit 344 is connected to the shoe light source 346 such that the shoe control unit 344 can be configured to control switching on and switching off the shoe light source 346, in communication with the practice aid device 104, such that the shoe light source 346 is configured to emit a game information shoe light signal 148, which can be seen by other players 122 and spectators 124, such that the game information shoe light signal 148 provides game information to players 122 and spectators 124.

In related embodiments, the shoe control unit 344 can be configured to use motion and location information provided by the shoe motion and location sensor 349 to detect gameplay violations such as "offside" in soccer, entering a "red zone" or other designated game field area, or detecting that a player is deviating from a current deviation from play strategy, such as a "triangle offense; wherein any detected violation, deviation, or condition can be signaled to the player 122, players 124, or spectators using the shoe light source 346, the shoe vibrator 348, the ball light source 336, or a combination of these.

In a related embodiment, when the practice aid device 104 registers the score, the ball control unit 334 can be configured to control the ball light source 336 to emit the game information ball light signal 136 as a point scored ball light signal, in order to communicate the score. The point scored ball light signal can for example be a relatively fast pulsating green light, wherein for example each on-pulse (i.e. light on) has a duration of 0.1-0.3 seconds followed by an off-pulse (i.e. light off) of a duration of 0.05-0.1 seconds.

In another related embodiment, the game information vibration signal 347 can be selected from the group consisting of (i.e. can be one of the following options):

a) a defensive mode game information vibration signal, which is a first predetermined vibration signal to indicate to the player that the player should assume a predetermined defensive playing style (or strategy); and b) an offensive mode game information vibration signal, which is a second predetermined vibration signal to indicate to the player that the player should assume a predetermined offensive playing style (or strategy), such as for example a "triangle offense" offensive playing strategy used in basketball;

wherein, as an example, the defensive mode game information signal can be a relatively slow pulsing signal followed by an equally long pause (compared to length of preceding slow pulse signal), and the offensive mode game information signal can be a relatively fast pulsing signal followed by a half-length pause (compared to length of preceding fast pulse signal).

In yet another related embodiment, when the practice aid device 104 registers the score, the shoe control unit 344 can be configured to control the shoe light source 346 to emit the game information shoe light signal 136 as a point scored shoe light signal, in order to communicate the score. The point scored shoe light signal can for example be a relatively fast pulsating green light, wherein for example each on-pulse (i.e. light on) has a duration of 0.1-0.3 seconds followed by an off-pulse (i.e. light off) of a duration of 0.05-0.1 seconds. The point scored shoe light signal can be activated on both shoes of scoring player 122 or can alternatively be activated on both shoes of all players 122 of scoring team, or on all players 122 from both teams. The point scored shoe light signal(s) and point scored ball light signal can provide additional game excitement and can also be used to inform spectators 124 of a score when the spectators 124 may not be able to see the scoring clearly from a distance.

In yet a related embodiment, as shown in FIG. 3B, the hoop sensor system 110 can further include a hoop control unit 314, which can be connected to the first and second optical transmitters 214, 224, the first and second optical receivers 216, 226, an the at least one programmable light 232, such that the hoop control unit 314 is configured to control functions of the first and second optical transmitters 214, 224, the first and second optical receivers 216, 226, and the at least one programmable light 232; wherein the in communication with the practice aid server 302, or alternatively in communication with the practice aid device 104

In a related embodiment, the shoe control unit 344 can be configured to calibrate a position/location of the intelligent shoe 140, by successively positioning the intelligent shoe 140 in the four corners 161, 162, 163, 164 of the playing field 160, such as a basketball court 160, such that the position/location of the intelligent shoe 140 provided by the shoe motion and location sensor 349, can be calibrated in comparison with predetermined/known locations of the four corners 161, 162, 163, 164.

In another related embodiment, the practice aid device 104 can be configured to transmit the registered score 152 to an electronic scoreboard 150, which can include a conventional scoreboard (such as used in a playing court with spectators), a television, a tablet device, or some other form of display device. Alternatively, as shown in FIG. 3B, the practice aid server 302 can be configured to store and update the registered score 152, such that the practice aid server 302 communicates with the electronic scoreboard 150 for display of the registered score 152 on the electronic scoreboard 150.

In other related embodiments, the first and second sensor pairs 212, 222 can be similar in design to conventional garage sensors and can for example employ an optical transmitter 214, 224, which can be an infrared or laser emitter.

In other related embodiments, the inflatable ball body 332 can be at least semi-transparent, including transparent or translucent, wherein the ball light source 336, is mounted inside the inflatable ball body 332, such that light emitted from the ball light source 336 is externally visible.

Figure 2A:
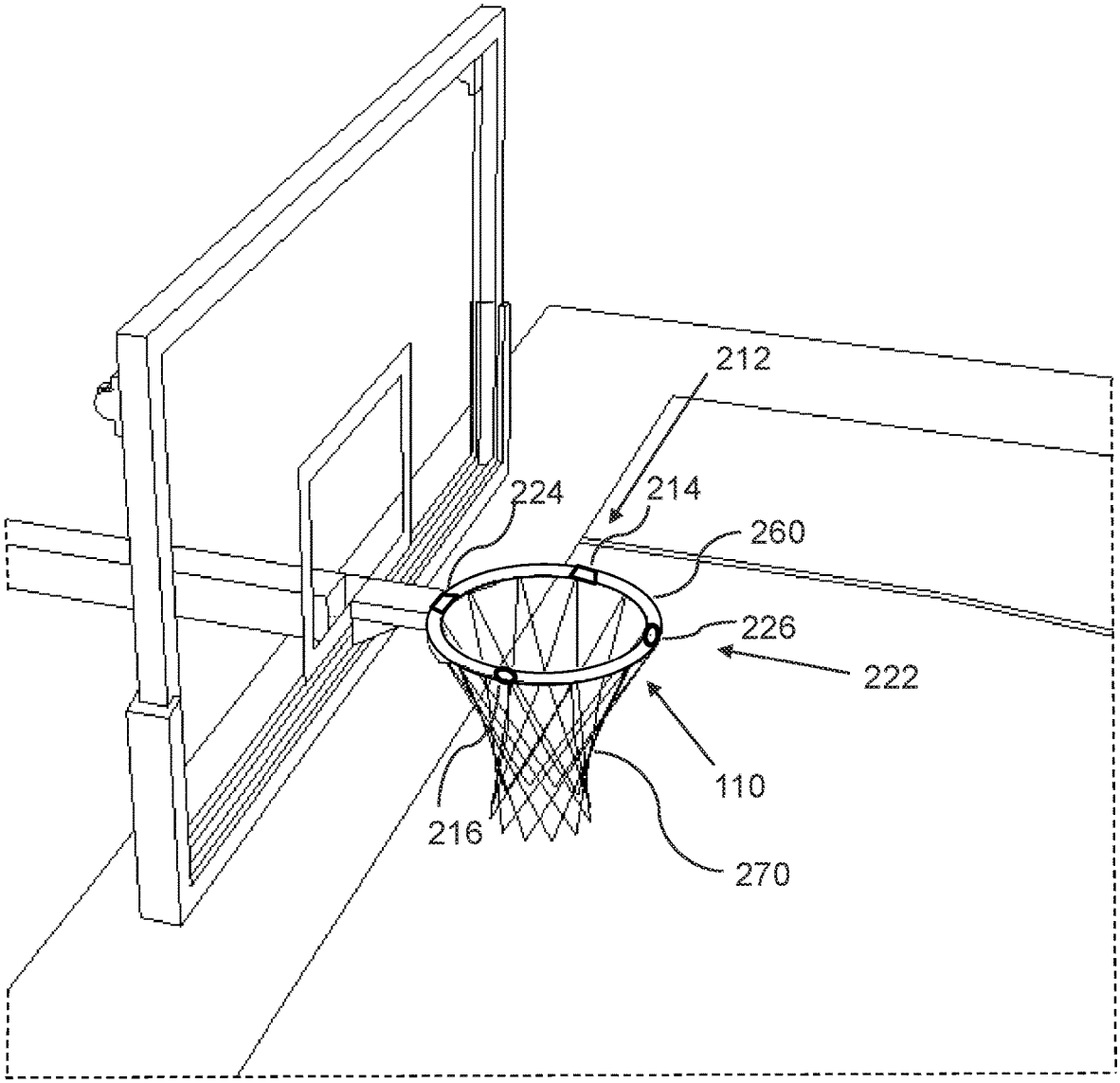
FIG. 2A is a perspective view of a part of a practice aid system, according to an embodiment of the invention.
Figure 2B:
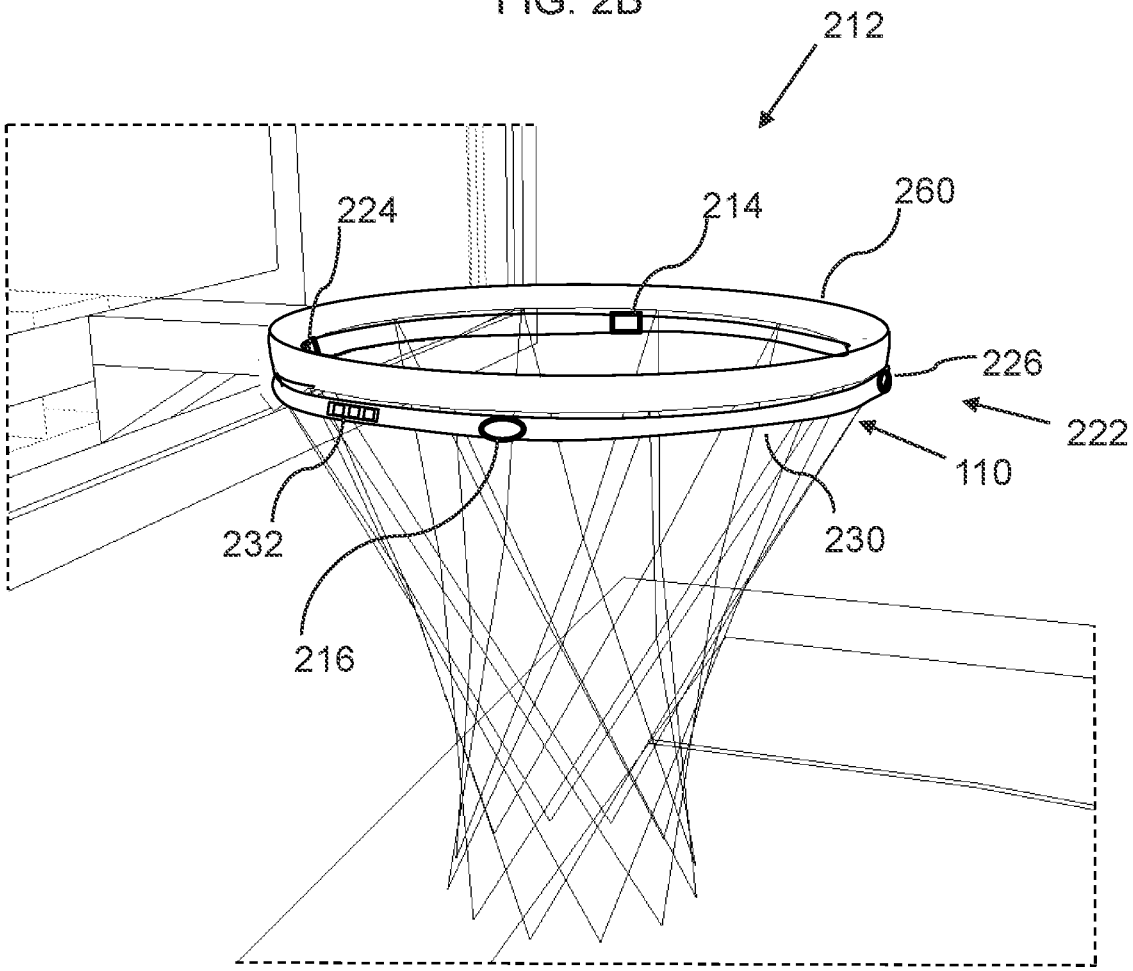
FIG. 2B is a perspective view of a part of a practice aid system, according to an embodiment of the invention.

In another related embodiment, as shown in FIGS. 2B, 3A, and 3B, the hoop sensor system 110 can further include:

- a mounting structure 230, which can be a ring-shaped mounting ring;
- wherein the first optical transmitter 214 is mounted on a first side of the mounting structure 230; and
- wherein the first optical receiver 216 is mounted on a second side of the mounting structure 230, such that the first and second sides are opposing sides of the mounting structure 230; and
- wherein the second optical transmitter 224 is mounted on a third side of the mounting structure 230; and
- wherein the second optical receiver is mounted on a fourth side of the mounting structure 230, such that the third and fourth sides are opposing sides of the mounting structure 230; and
- wherein the second sensor pair 222 is substantially perpendicularly mounted on the mounting structure 230 relative to the first sensor pair 212;
- such that the mounting structure 230 for example can be connected to the hoop rim 260, such that the mounting structure 230 is mounted directly under the hoop rim 260, for example as shown on an outer side of a hoop netting 270.

Figure 4:
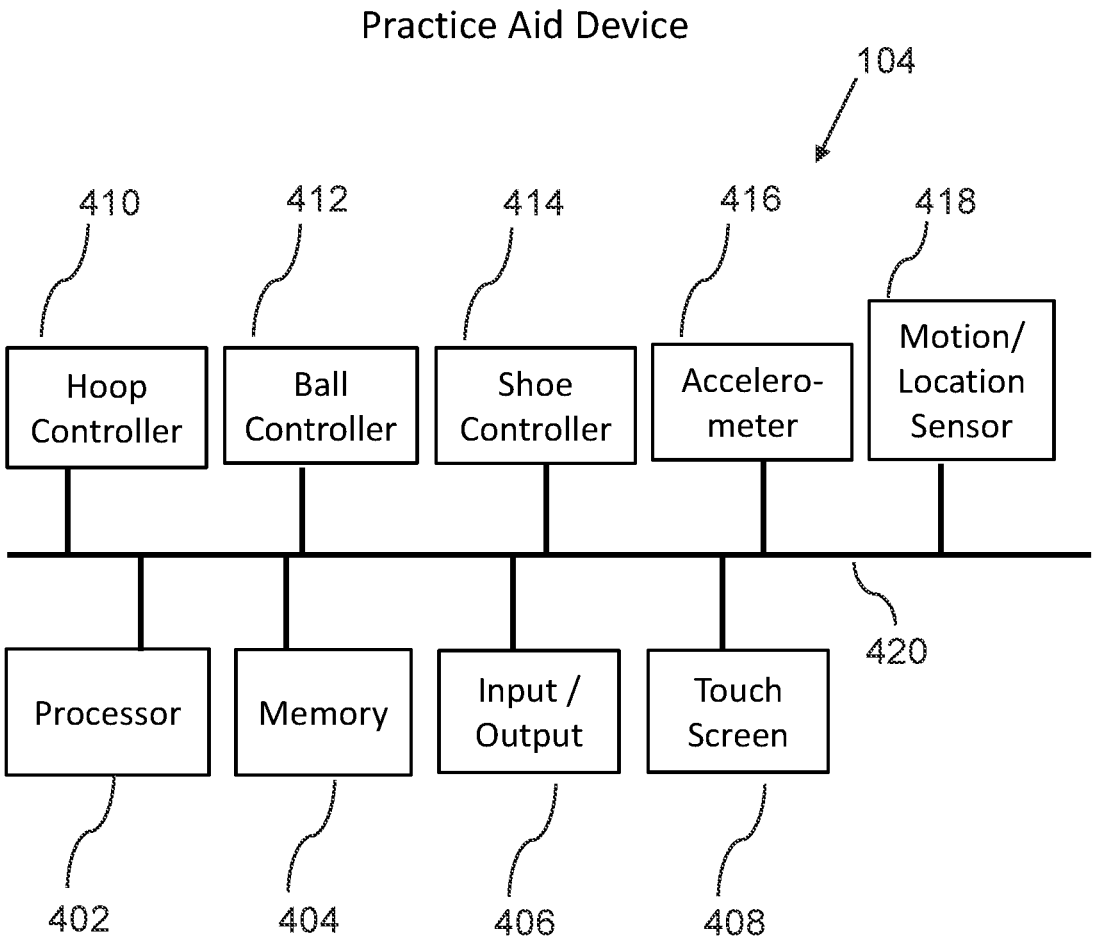
FIG. 4 is a schematic diagram of a practice aid device, according to an embodiment of the invention.

In another related embodiment, as shown in FIGS. 2B, 3A, and 3B, the hoop sensor system 110 can further include:

- at least one programmable light 232, or a plurality of which can be mounted on the mounting structure 230,
- such that the at least one programmable light 232 can be controlled in communication with the practice aid device 104, as shown in FIG. 3A; and/or
- such that the at least one programmable light 232 can be controlled in communication with the practice aid server 302, as shown in FIG. 3B;

In a related embodiment, as shown in FIG. 4, a practice aid device 104 can include:

a) A processor 402;
b) A non-transitory memory 404;
c) An input/output component 406;
d) A screen 408, which can be a touch screen;
e) A hoop controller 410, which can be configured to control functions of the hoop sensor system 110, such that the hoop controller 410 registers a score when the first sensor pair 212 and the second sensor pair 222 register a simultaneous blockage of respectively first and second optical transmission signals;
f) A ball controller 412, which can be configured to control functions of the intelligent ball 130, such that the ball controller 412 is configured to control switching on and switching off of the ball light source 336 in communication with the ball control unit 334;
g) A shoe controller 414, which can be configured to control functions of the intelligent shoe 140;
   - such that the shoe controller 414 is configured to receive motion information from the shoe motion and location sensor 349 in communication with the shoe control unit 344;
   - such that the shoe controller 414 is configured to control switching on and switching off of the vibrator 348 in communication with the shoe control unit 344;
   - such that the shoe controller 414 is configured to control switching on and switching off of the shoe light source 346 in communication with the shoe control unit 344;
h) An accelerometer 416, which is configured to measure an acceleration 108 of the practice aid device 104. The accelerometer 416 can be a multi-axis accelerometer, which can detect both the magnitude and the direction of the acceleration, such that the accelerometer 416 provides an output in the form of an acceleration vector 108; and
i) a device motion and location sensor 418, wherein the device motion and location sensor 418 can be configured to determine device motion information of the practice aid device 104 (and thereby of the outer wrist/hand of the player 122), wherein the device motion information can include a location/position and a velocity of the practice aid device 104; all connected via
j) A data bus 420.

In a related embodiment, as shown in FIG. 3B, a practice aid system 100 can further include a practice aid server 302, which is connected to the hoop sensor system 110, the intelligent ball 130, and the intelligent shoe 140, such that the practice aid device 104 controls functions of the practice aid system 100 in communication via the practice aid server 302.

In another related embodiment, as shown in FIG. 3B, a practice aid device 104 can be configured for use by a coach 324 or manager 324 to receive real-time data and provide instructions in communication with the practice aid system 100, for example for the purpose of training or evaluation.

In yet another related embodiment, as shown in FIG. 3B, a practice aid device 104 can be configured for use by a referee 326 or umpire 326 to receive real-time data and provide gameplay decisions and instructions in communication with the practice aid system 100.

In related embodiments, the practice aid system 100 can be used for basketball and other sports using a ball, such as for example baseball, American football, tennis, soccer, etc.

Figure 5:
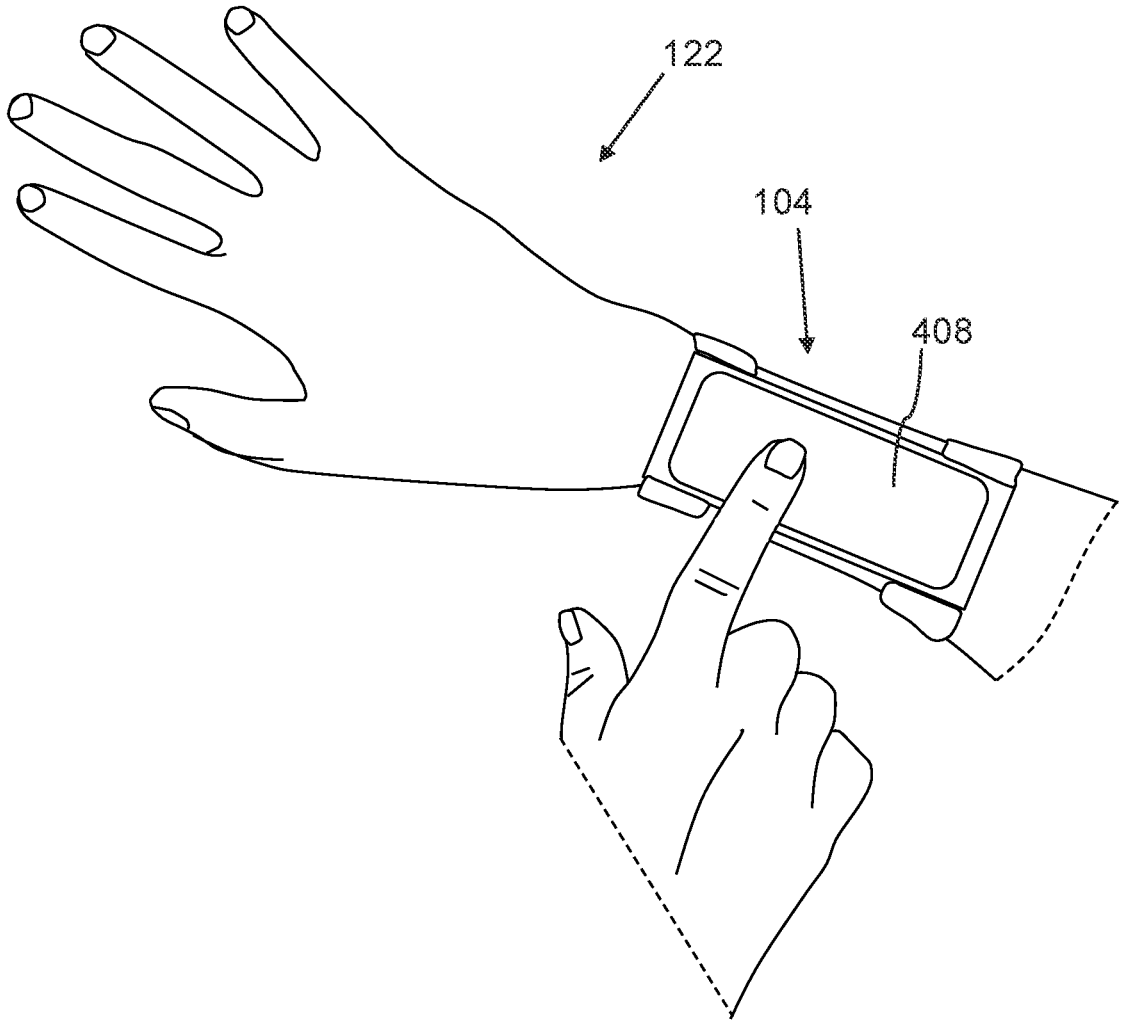
FIG. 5 is a perspective view of a practice aid device, according to an embodiment of the invention.

In a related embodiment, FIG. 5 shows a user 122 operating a practice aid device 104 via interaction with the screen 408, which is configured as a touch screen.

Figure 6:
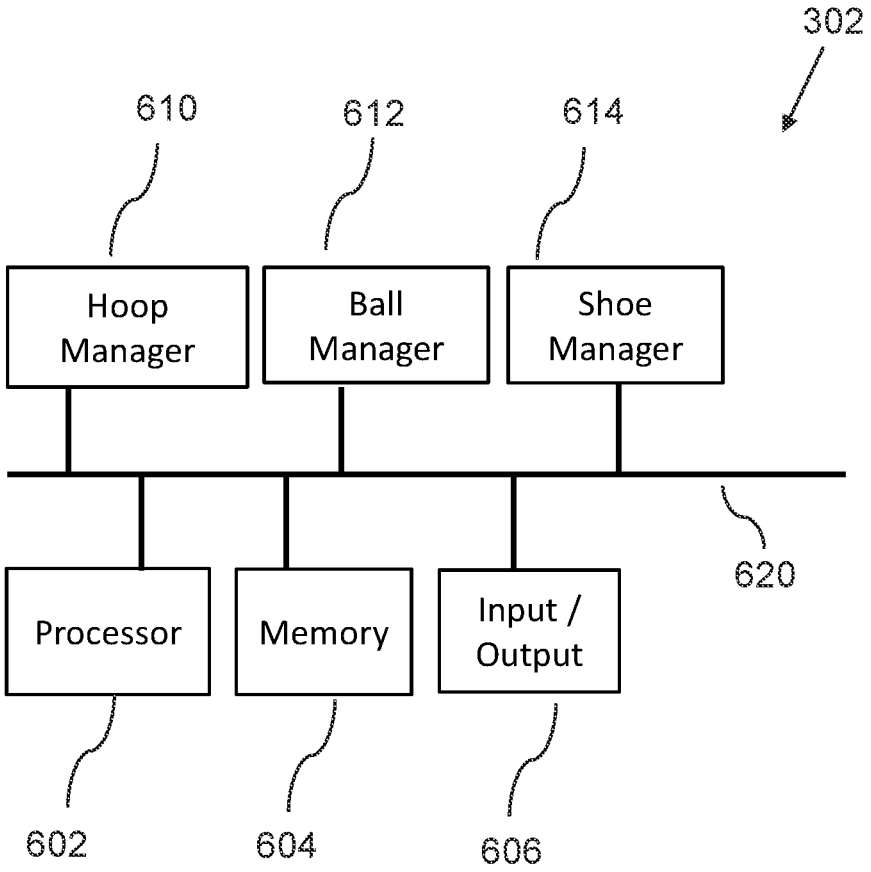
FIG. 6 is a schematic diagram of a practice aid server, according to an embodiment of the invention.

In a related embodiment, as shown in FIG. 6, a practice aid server 302 can include:

a) A processor 602;
b) A non-transitory memory 604;
c) An input/output component 606;
d) A hoop manager 610, which can be configured to control functions of the hoop sensor system 110, such that the hoop manager 610 registers a score when the first sensor pair 212 and the second sensor pair 222 register a simultaneous blockage of respectively first and second optical transmission signals;

e) A ball manager 612, which can be configured to control functions of the intelligent ball 130, such that the ball manager 612 is configured to control switching on and switching off of the ball light source 336 in communication with the ball control unit 334; and f) A shoe manager 614, which can be configured to control functions of the intelligent shoe 140;

such that the shoe manager 614 is configured to receive motion information from the shoe motion and location sensor 349 in communication with the shoe control unit 344;

such that the shoe manager 614 is configured to control switching on and switching off of the vibrator 348 in communication with the shoe control unit 344;

such that the shoe controller 414 is configured to control switching on and switching off of the shoe light source 346 in communication with the shoe control unit 344; all connected via g) A data bus 620;

such that the hoop controller 410 of the practice aid device 104 can control functions of the hoop sensor system 110 in communication with the hoop manager 610;

such that the ball controller 412 of the practice aid device 104 can control functions of the intelligent ball 130 in communication with the ball manager 612; and such that the shoe controller 414 of the practice aid device 104 can control functions of the intelligent shoe 140 in communication with the shoe manager 614.

In a related embodiment, in a performance scenario during use of the practice aid system 100, wherein a player 122 is dribbling on the court and takes a shot at the basketball hoop, actions of the practice aid system 100 can include:

a) wherein the practice aid device 104 can be configured to record and store the player's 122 movement's as a sequence of location records comprising a court location and a timestamp, wherein the court location is obtained in communication with the shoe motion and location sensor 349 of the intelligent shoe 140;

b) wherein the practice aid device 104 can be configured to record a throw movement 108 when the device accelerometer 416 registers a sudden acceleration 108;

c) wherein when the hoop sensor system 110 registers a score:

i. The practice aid server 302 can be configured to record and save the score and update a registered score 152;

ii. The hoop sensor system 110 can provide visual confirmation of the score by showing a predetermined lighting sequence on the programmable lights 232 of the hoop sensor system 110, which can be LED lights;

iii. The practice aid server 302, in communication via the shoe control unit 344, can be configured to control the shoe light source 346 of the intelligent shoe 140, to emit a game information shoe light signal 148 (such as flashing lights, which can be flashing in a designated color, such as blue or green) in order to communicate the successful score;

iv. The practice aid server 302 can be configured to control the vibrator 348 of the intelligent shoe 140, to send a tactile feedback (i.e. a vibration) to a player 122 in order to communicate the successful score;

v. The practice aid server 302 can be configured to control the ball light source 336 of the intelligent ball 130, to emit a game information ball light signal 136 (such as flashing lights, which can be flashing in a designated color, such as blue or green) in order to communicate the successful score;

vi. The practice aid server 302 can be configured to send recorded shot data to the practice aid device 104, and to control a visual feedback communicated via the screen 408 of the practice aid device 104; and/or a tactile feedback provided via a vibrator of the practice aid device 104. The visual and/or tactile feedback can be configured to be sent to any customized combination of players 122, via their respective practice aid devices 104;

d) wherein the PA system can provide score data 152 and player data to an electronic scoreboard 150;

e) wherein system performance data can be recorded and saved by the practice aid server 302, wherein the system performance data can include:

i. ball speed, ball velocity, ball height, provided in communication with the ball motion and location sensor 339 of the intelligent ball 130;

ii. shoe position, shoe height, provided in communication with the shoe motion and location sensor 349 of the intelligent shoe 140;

iii. position and velocity of the practice aid device 104, provided in communication with the device motion and location sensor 418 of the practice aid device 104;

iv. playing court location; and v. player info, etc.;

such that the practice aid server 302 can be configured to enable an administrator/coach 324 to review performance metrics (for example based on custom requests) and generate custom reports comprising player performance metrics.

In related embodiments, the practice aid device 104 can include configurations as:

a) A mobile app, executing on a mobile device, such as for example a smart phone, and ANDROID™ phone or IPHONE™, or any wearable mobile device;

b) A tablet app, executing on a tablet device, such as for example an ANDROID™ or IOS™ tablet device;

c) A web application, executing in a Web browser;

d) A desktop application, executing on a personal computer, or similar device;

e) An embedded application, executing on a processing device, such as for example a smart TV, a game console or other system.

It shall be understood that an executing instance of an embodiment of the practice aid system 100, as shown in FIGS. 1A and 3A, can include a plurality of practice aid devices 104, which are each tied to (and worn by) a corresponding user 122 in a plurality of users 122, for example as shown in FIG. 3B.

An executing instance of an embodiment of the system for practice aid system 100, as shown in FIGS. 3A and 3B, can similarly include a plurality of practice aid servers 302.

FIGS. 1A, 1B, 2A, 2B, 3A, 3B, 4, 5, and 6 are block diagrams and flowcharts, methods, devices, systems, apparatuses, and computer program products according to various embodiments of the present invention. It shall be understood that each block or step of the block diagram, flowchart and control flow illustrations, and combinations of blocks in the block diagram, flowchart and control flow illustrations, can be implemented by computer program instructions or other means. Although computer program instructions are discussed, an apparatus or system according to the present invention can include other means, such as hardware or some combination of hardware and software, including one or more processors or controllers, for performing the disclosed functions.

In this regard, FIGS. 1A, 1B, 2A, 2B, 3A, 3B, 4, 5, and 6 depict the computer devices of various embodiments, each containing several of the key components of a general-purpose computer by which an embodiment of the present invention may be implemented. Those of ordinary skill in the art will appreciate that a computer can include many components. However, it is not necessary that all of these generally conventional components be shown in order to disclose an illustrative embodiment for practicing the invention. The general-purpose computer can include a processing unit and a system memory, which may include various forms of non-transitory storage media such as random access memory (RAM) and read-only memory (ROM). The computer also may include nonvolatile storage memory, such as a hard disk drive, where additional data can be stored.

FIG. 3B shows a depiction of an embodiment of the practice aid system 300, including a practice aid server 302, and the practice aid device 104. In this relation, a server shall be understood to represent a general computing capability that can be physically manifested as one, two, or a plurality of individual physical computing devices, located at one or several physical locations. A server can for example be manifested as a shared computational use of one single desktop computer, a dedicated server, a cluster of rack-mounted physical servers, a datacenter, or network of datacenters, each such datacenter containing a plurality of physical servers, or a computing cloud, such as AMAZON EC2™ or MICROSOFT AZURE™.

It shall be understood that the above-mentioned components of practice aid server 302 and the practice aid device 104 are to be interpreted in the most general manner.

For example, the processors 402, 602 can each respectively include a single physical microprocessor or microcontroller, a cluster of processors, a datacenter or a cluster of datacenters, a computing cloud service, and the like.

In a further example, the non-transitory memory 404 and the non-transitory memory 604 can each respectively include various forms of non-transitory storage media, including random access memory and other forms of dynamic storage, and hard disks, hard disk clusters, cloud storage services, and other forms of long-term storage. Similarly, the input/output 406 and the input/output 606 can each respectively include a plurality of well-known input/output devices, such as screens, keyboards, pointing devices, motion trackers, communication ports, and so forth.

Furthermore, it shall be understood that the practice aid server 302 and the practice aid device 104 can each respectively include a number of other components that are well known in the art of general computer devices, and therefore shall not be further described herein. This can include system access to common functions and hardware, such as for example via operating system layers such as WINDOWS™, LINUX™, and similar operating system software, but can also include configurations wherein application services are executing directly on server hardware or via a hardware abstraction layer other than a complete operating system.

An embodiment of the present invention can also include one or more input or output components, such as a mouse, keyboard, monitor, and the like. A display can be provided for viewing text and graphical data, as well as a user interface to allow a user to request specific operations. Furthermore, an embodiment of the present invention may be connected to one or more remote computers via a network interface. The connection may be over a local area network (LAN) wide area network (WAN), and can include all of the necessary circuitry for such a connection.

In related embodiments, the practice aid device 104 can communicate with the practice aid server 302, or directly with the hoop sensor system 110, the intelligent ball 130, the intelligent shoe 140, and/or the electronic scoreboard 150 over a network 306, which can include the general Internet, a Wide Area Network or a Local Area Network, or another form of communication network, transmitted on at least one or a combination of wired (such as Ethernet) or wireless connections. Wireless networks can for example include Wi-Fi, BLUETOOTH™, ZIGBEE™, and NFC. The communication can be transferred via a secure, encrypted communication protocol. Alternatively, as shown in FIG. 3B, the practice aid server 302 can communicate directly with the hoop sensor system 110, intelligent ball 130, the intelligent shoe 140, and/or the electronic scoreboard 150 over a network 306, which can include the general Internet, a Wide Area Network or a Local Area Network, or another form of communication network, transmitted on at least one or a combination of wired or wireless connections.

Typically, computer program instructions may be loaded onto the computer or other general-purpose programmable machine to produce a specialized machine, such that the instructions that execute on the computer or other programmable machine create means for implementing the functions specified in the block diagrams, schematic diagrams or flowcharts. Such computer program instructions may also be stored in a computer-readable medium that when loaded into a computer or other programmable machine can direct the machine to function in a particular manner, such that the instructions stored in the computer-readable medium produce an article of manufacture including instruction means that implement the function specified in the block diagrams, schematic diagrams or flowcharts.

In addition, the computer program instructions may be loaded into a computer or other programmable machine to cause a series of operational steps to be performed by the computer or other programmable machine to produce a computer-implemented process, such that the instructions that execute on the computer or other programmable machine provide steps for implementing the functions specified in the block diagram, schematic diagram, flowchart block or step.

Accordingly, blocks or steps of the block diagram, flowchart or control flow illustrations support combinations of means for performing the specified functions, combinations of steps for performing the specified functions and program instruction means for performing the specified functions. It will also be understood that each block or step of the block diagrams, schematic diagrams or flowcharts, as well as combinations of blocks or steps, can be implemented by special purpose hardware-based computer systems, or combinations of special purpose hardware and computer instructions, that perform the specified functions or steps.

As an example, provided for purposes of illustration only, a data input software tool of a search engine application can be a representative means for receiving a query including one or more search terms. Similar software tools of applications, or implementations of embodiments of the present invention, can be means for performing the specified functions. For example, an embodiment of the present invention may include computer software for interfacing a processing element with a user-controlled input device, such as a mouse, keyboard, touch screen display, scanner, or the like. Similarly, an output of an embodiment of the present invention may include, for example, a combination of display software, video card hardware, and display hardware. A processing element may include, for example, a controller or microprocessor, such as a central processing unit (CPU), arithmetic logic unit (ALU), or control unit.

Here has thus been described a multitude of embodiments of the practice aid system 100, the practice aid device 104, the practice aid server 302, and methods related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

For example, alternative embodiments can reconfigure or combine the components of the practice aid server 302, and the practice aid device 104. The components of the practice aid server 302 can be distributed over a plurality of physical, logical, or virtual servers. Parts or all of the components of the practice aid device 104 can be configured to operate in the practice aid server 302, whereby the practice aid device 104 for example can function as a thin client, performing only graphical user interface presentation and input/output functions. Alternatively, parts or all of the components of the practice aid server 302 can be configured to operate in the practice aid device 104, as shown in FIG. 3A.

Many such alternative configurations are readily apparent and should be considered fully included in this specification and the claims appended hereto. Accordingly, since numerous modifications and variations will readily occur to those skilled in the art, the invention is not limited to the exact construction and operation illustrated and described, and thus, all suitable modifications and equivalents may be resorted to, falling within the scope of the invention.

What is claimed is:

1. A practice aid system, comprising:

a) a practice aid device; and b) a hoop sensor system, including:

a first sensor pair, comprising:

a first optical transmitter, which is configured to be mounted on a first side of a hoop rim of a basketball hoop; and a first optical receiver, which is configured to be mounted on a second side of the hoop rim, such that the first and second sides are first opposing sides of the hoop rim, such that the first optical receiver receives a first optical emission from the first optical transmitter when there is no blockage of a first opening between the first optical transmitter and the first optical receiver, and such that the first optical receiver is configured to detect a first blockage of the first opening when the first optical emission is not received; and a second sensor pair, comprising:

a second optical transmitter, which is configured to be mounted on a third side of the hoop rim; and a second optical receiver, which is configured to be mounted on a fourth side of the hoop rim, such that the third and fourth sides are second opposing sides of the hoop rim, such that the second optical receiver receives a second optical emission from the second optical transmitter when there is no blockage of a second opening between the second optical transmitter and the second optical receiver, and such that the second optical receiver detects a second blockage of the second opening when the second optical emission is not received;

wherein the practice aid device is configured to register a score when the first sensor pair and the second sensor pair detect simultaneous first and second blockages of respectively the first and second openings; and c) an intelligent shoe, comprising:

a shoe body;

a shoe control unit, which is mounted to the shoe body;

a shoe motion and location sensor, which is mounted to the shoe body; and a vibrator, which is mounted to the shoe body;

wherein the shoe control unit is connected to the shoe motion and location sensor, such that the shoe control unit is configured to receive motion and location information from the shoe motion and location sensor, in communication with the practice aid device;

wherein the shoe control unit is connected to the vibrator, such that the shoe control unit is configured to control switching on and switching off the vibrator, in communication with the practice aid device, such that the vibrator is configured to emit a game information vibration signal, which is received by a player who is wearing the intelligent shoe, wherein the game information vibration signal provides game information to the player; and wherein the shoe control unit is configured to start a timer when the shoe motion and location sensor indicates the player has entered a defensive key zone, such that the timer stops when the player has left the defensive key zone, such that the vibrator is configured to emit a warning vibration signal when the timer reaches two seconds, to warn the player of a potential three second key zone violation.

2. The practice aid system of claim 1, wherein the practice aid device is configured to be mounted on a forearm of a user.

3. The practice aid system of claim 1, further comprising:

an intelligent ball, comprising:

an inflatable ball body;

a ball control unit; and a ball light source, such that the ball light source is mounted to the inflatable ball body;

wherein the ball control unit is connected to the ball light source such that the ball control unit is configured to control switching on and switching off the ball light source, in communication with the practice aid device, such that the ball light source is configured to emit a game information ball light signal, which provides game information to players and spectators.

4. The practice aid system of claim 3, wherein when the practice aid device registers the score, the ball control unit is configured to control the ball light source to emit the game information ball light signal as a point scored ball light signal, in order to communicate the score.

5. The practice aid system of claim 3, wherein the ball light source is mounted inside the inflatable ball body, and wherein the inflatable ball body is at least semi-transparent.

6. The practice aid system of claim 3, wherein the ball light source comprises a light emitting diode assembly.

7. The practice aid system of claim 1, wherein the shoe control unit is configured to calibrate a position of the intelligent shoe, by successively positioning the intelligent shoe in four corners of a playing field, such that the position of the intelligent shoe is calibrated in comparison with predetermined locations of the four corners.

8. The practice aid system of claim 1, wherein the shoe control unit is connected to the vibrator, such that the shoe control unit is configured to control switching on and switching off the vibrator, in communication with the practice aid device, such that the vibrator is configured to emit a game information vibration signal, which is received by a player who is wearing the intelligent shoe, wherein the game information vibration signal provides game information to the player.

9. The practice aid system of claim 8, wherein the game information vibration signal is selected from the group consisting of:

a) a defensive mode game information vibration signal, which is a first predetermined vibration signal to indicate to the player that the player should assume a defensive playing style; and b) an offensive mode game information vibration signal, which is a second predetermined vibration signal to indicate to the player that the player should assume an offensive playing style.

10. The practice aid system of claim 1, wherein the shoe control unit is connected to the shoe light source, such that the shoe control unit is configured to control switching on and switching off the shoe light source, in communication with the practice aid device, such that the shoe light source is configured to emit a game information shoe light signal, which provides game information to players and spectators.

11. The practice aid system of claim 10, wherein when the practice aid device registers the score, the shoe control unit is configured to control the shoe light source to emit the game information shoe light signal as a point scored shoe light signal, in order to communicate the score.

12. The practice aid system of claim 1, wherein the second sensor pair is configured to be perpendicularly mounted on the hoop rim relative to the first sensor pair.

13. The practice aid system of claim 1, wherein the hoop sensor system further comprises:

a mounting structure;

wherein the first optical transmitter is mounted on a first side of the mounting structure;

wherein the first optical receiver is mounted on a second side of the mounting structure;

wherein the second optical transmitter is mounted on a third side of the mounting structure; and wherein the second optical receiver is mounted on a fourth side of the mounting structure.

14. The practice aid system of claim 13, wherein the mounting structure is a ring-shaped mounting ring.

15. The practice aid system of claim 13, wherein the second sensor pair is perpendicularly mounted on the mounting structure relative to the first sensor pair.

16. The practice aid system of claim 13, wherein the practice aid system further comprises the basketball hoop, which comprises the hoop rim; wherein the mounting structure is connected to the hoop rim, such that the mounting structure is mounted under the hoop rim.

17. A practice aid system, comprising:

a) a practice aid device; and b) a hoop sensor system, including:

a first sensor pair, comprising:

a first optical transmitter, which is configured to be mounted on a first side of a hoop rim of a basketball hoop; and a first optical receiver, which is configured to be mounted on a second side of the hoop rim, such that the first and second sides are first opposing sides of the hoop rim, such that the first optical receiver receives a first optical emission from the first optical transmitter when there is no blockage of a first opening between the first optical transmitter and the first optical receiver, and such that the first optical receiver is configured to detect a first blockage of the first opening when the first optical emission is not received; and a second sensor pair, comprising:

a second optical transmitter, which is configured to be mounted on a third side of the hoop rim; and a second optical receiver, which is configured to be mounted on a fourth side of the hoop rim, such that the third and fourth sides are second opposing sides of the hoop rim, such that the second optical receiver receives a second optical emission from the second optical transmitter when there is no blockage of a second opening between the second optical transmitter and the second optical receiver, and such that the second optical receiver detects a second blockage of the second opening when the second optical emission is not received;

wherein the practice aid device is configured to register a score when the first sensor pair and the second sensor pair detect simultaneous first and second blockages of respectively the first and second openings; and c) an intelligent shoe, comprising:

a shoe body;

a shoe control unit, which is mounted to the shoe body;

a shoe motion and location sensor, which is mounted to the shoe body; and wherein the shoe control unit is connected to the shoe motion and location sensor, such that the shoe control unit is configured to receive motion and location information from the shoe motion and location sensor, in communication with the practice aid device;

wherein the shoe control unit is configured to calibrate a position of the intelligent shoe, by successively positioning the intelligent shoe in four corners of a playing field, such that the position of the intelligent shoe is calibrated in comparison with predetermined locations of the four corners.

* * * * *